US008323003B2

(12) United States Patent
Judge et al.

(10) Patent No.: US 8,323,003 B2
(45) Date of Patent: Dec. 4, 2012

(54) PRESSURE DRIVEN PUMPING SYSTEM

(75) Inventors: Robert Arnold Judge, Houston, TX (US); Peringandoor Raman Hariharan, Houston, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 2242 days.

(21) Appl. No.: 11/077,499

(22) Filed: Mar. 10, 2005

(65) Prior Publication Data

US 2006/0204375 A1 Sep. 14, 2006

(51) Int. Cl.
*F04B 17/00* (2006.01)
*F04B 35/00* (2006.01)

(52) U.S. Cl. ..... 417/404

(58) Field of Classification Search ..... 417/338–347, 417/348, 392, 393, 423.1, 423.14, 423.15, 417/234; 166/105, 153, 335
See application file for complete search history.

(56) References Cited

U.S. PATENT DOCUMENTS

| | | | | |
|---|---|---|---|---|
| 3,654,995 | A * | 4/1972 | Sizer | 166/313 |
| 4,178,240 | A * | 12/1979 | Pinkerton | 210/646 |
| 4,405,291 | A * | 9/1983 | Canalizo | 417/393 |
| 4,459,089 | A * | 7/1984 | Vincent et al. | 417/383 |
| 4,580,952 | A | 4/1986 | Eberle | |
| 4,606,709 | A * | 8/1986 | Chisolm | 417/347 |
| 4,705,458 | A | 11/1987 | St. Laurent et al. | |
| 5,064,350 | A * | 11/1991 | Ege | 417/63 |
| 5,564,912 | A * | 10/1996 | Peck et al. | 417/396 |
| 5,575,625 | A | 11/1996 | Castel | |
| 5,616,005 | A * | 4/1997 | Whitehead | 417/46 |
| 5,634,779 | A | 6/1997 | Eysymontt | |
| 6,202,753 | B1 | 3/2001 | Baugh | |
| 6,203,696 | B1 * | 3/2001 | Pearson | 210/98 |
| 6,263,971 | B1 | 7/2001 | Giannesini | |
| 6,325,159 | B1 | 12/2001 | Peterman et al. | |
| 6,415,877 | B1 | 7/2002 | Fincher et al. | |
| 6,457,529 | B2 | 10/2002 | Calder et al. | |
| 6,478,552 | B1 * | 11/2002 | Batten et al. | 417/393 |
| 6,505,691 | B2 | 1/2003 | Judge et al. | |
| 6,592,334 | B1 | 7/2003 | Butler | |
| 6,648,081 | B2 | 11/2003 | Fincher et al. | |
| 6,719,071 | B1 | 4/2004 | Moyes | |
| 2004/0007392 | A1 | 1/2004 | Judge et al. | |

OTHER PUBLICATIONS

H. J. Grimstad, "Subsea Multiphase Boosting—Maturing Technology Applied for Santos Ltd's Mutineer and Exeter Field", SPE International (SPE 88562) (10 pages).

* cited by examiner

*Primary Examiner* — Devon Kramer
*Assistant Examiner* — Amene Bayou
(74) *Attorney, Agent, or Firm* — Bracewell & Giuliani LLP

(57) ABSTRACT

A pump includes a housing partially bounded by first and second outer walls, an inner wall fixed within a bore, a first piston disposed between the first outer wall and the inner wall, a second piston disposed between the second outer wall and the inner wall, a coupling member coupling the first and second pistons, a plurality of valves, and a control unit configured to communicate with the plurality of valves. Wherein One of a first inner chamber and a first outer chamber is configured to receive process fluid and the other of the first inner chamber and the first outer chamber is configured to receive working fluid, and one of a second inner chamber and a second outer chamber is configured to receive damping fluid and the other of the second inner chamber and the second outer chamber is configured to receive working fluid.

23 Claims, 6 Drawing Sheets

PRESSURE DRIVEN PUMPING SYSTEM

CROSS-REFERENCE TO RELATED APPLICATIONS

The present application is related to a United States patent application filed herewith titled "Pressure Driven Pumping System" Ser. No. 11/077,172, now U.S. Pat. No. 7,735,563, and assigned to the assignee of the present application. That application is incorporated herein by reference in its entirety.

BACKGROUND OF INVENTION

1. Field of the Invention

The invention relates generally to a pressure driven pump for pumping fluid from a wellhead. More particularly, the invention relates to a pumping system having a dogbone pumping element on which equal pressure may be applied for the pump and fill strokes.

2. Background Art

Pumps are used for a variety of tasks in the oil and gas industry. In particular, pumps are often used in subsea applications, such as for operating pressure driven subsea equipment (BOPs, gate valves, and the like), for bringing drilling mud to the surface while drilling, and for bringing produced fluids from a completed well to the surface.

Examples of pumping systems are disclosed in various patents. U.S. Pat. No. 6,325,159 to Mott, et al., discloses a plurality of pumping elements for passing drilling mud from a suction conduit to a discharge conduit. A pump draws hydraulic fluid from a reservoir and discharges pressurized working fluid to hydraulic power chambers of pumping elements, to pump drilling mud. The positions of the valves are determined by control logic in a control module. The timing sequence of filling one power chamber of one pumping element with hydraulic fluid while discharging hydraulic fluid from the power chamber of another pumping element is such that the total mud flow from the pumping elements is relatively free of pulsation. The pumping elements may be diaphragm elements or piston elements.

U.S. Pat. No. 6,102,673 issued to Mott, et al. discloses a subsea positive displacement pump with multiple pump elements, each pump element comprising a pressure vessel divided into two chambers by a separating member and powered by a closed hydraulic system using a subsea variable displacement hydraulic pump. The subsea positive displacement pump includes hydraulically actuated valves to ensure proper valve seating in the presence of, for example, cuttings from the drill bit that are present in mud returns from the wellbore. The hydraulically actuated valves also provide flexibility in valve timing and provides quick valve response in high flow coefficient (Cv) arrangements necessary for high volume pumping (e.g., substantially high flow rates).

U.S. Pat. No. 6,592,334 to Butler discloses a hydraulically driven multiphase pump system for pumping a fluid stream from the surface of a well. The system is intended to eliminate pressure spikes and priming problems of the plunger moving toward the extended position. The hydraulically driven multiphase pump system consists of two vertically disposed plungers. The plungers are hydraulically controlled and actuated to work in alternate directions during a cycle using a closed loop hydraulic system. Each cycle is automatically re-indexed to assure volumetric balance in the circuits. An indexing circuit ensures that each plunger reaches its full extended position prior to the other plunger reaching its preset retracted position. A bias member and an acceleration valve are used to prime the indexing circuit for use in low or variable inlet pressure situations. A power saving circuit is used to transfer energy from the extending plunger to the retracting plunger. Butler, therefore, requires a rather complicated system to minimize pressure spikes and losses.

An issue common to many pumping systems is that the pumping elements require a different flow rate of working fluid for the pump and fill functions. Typically, the pumping elements may be actuated by pressurized working fluid in only one direction, whereas the working fluid must be subsequently drawn out by suction created elsewhere in the system, such as during the pump stroke of another pumping element. This complicates the timing and sequencing of the multiple pumping elements required to produce a relatively uniform flow rate. A related issue is that operating multiple pumping elements may require multiple supply lines if the required fill and pump pressures are different. Yet another issue common to pumping systems is the need to maintain pressure in the system to prevent harmful or even catastrophic separation of various fluid components.

SUMMARY OF INVENTION

In one aspect, the present invention relates to a pressure driven pumping element including a housing having a bore at least partially bounded by first and second housing walls. A static separating member is positioned within the bore. A first dynamic separating member is movably disposed within the bore between the first housing wall and the static separating member to define a first outer chamber between the first housing wall and the first dynamic separating member and a first inner chamber between the first dynamic separating member and the static separating member. A second dynamic separating member is movably disposed within the bore between the second housing wall and the static separating member to define a second outer chamber between the second housing wall and the second dynamic separating member and a second inner chamber between the second dynamic separating member and the static separating member. A coupling member couples the first and second dynamic separating members and sealingly passes through the static separating member, such that the first and second dynamic separating members are movable together to vary the volumes of the outer chambers and the inner chambers.

In another aspect, the present invention relates to a method of pumping. The method includes placing first and second working chambers in communication with a working fluid source and passing working fluid to the second working chamber to discharge working fluid from the first working chamber and to draw process fluid into a process chamber. Working fluid is passed to the first working chamber to discharge working fluid from the second working chamber and to discharge process fluid from the process chamber.

In another aspect, the present invention relates to a method of controlling production from a well. The method includes placing a pressure driven pumping system in fluid communication with a well, wherein the pressure driven pumping system comprises at least one pumping element. A pump is placed into fluid communication with a working chamber in the at least one pumping element. The method further includes producing fluid from the well and monitoring a well parameter selected from a well pressure, a production rate, and a pumping element stroke rate. The output flow rate of the pump is adjusted. An increased output flow rate increases the production rate and a decreased output flow rate decreases the production rate.

In another aspect, the present invention relates to a method of injecting an injection well and producing from a production well. The method includes placing a working chamber of a pressure driven pumping system in fluid communication with the injection well and a pump. A process chamber of the pressure driven pumping system is placed in fluid communication with a production well. The method further includes pumping injection well fluid into the pressure driven pumping system, filling the process chamber with fluid from the production well, discharging the injection well fluid from the working chamber to the injection well, and discharging the fluid from the production well from the process chamber to a subsequent location.

In another aspect, the present invention relates to a pressure driven pumping system in a surface application. The pressure driven pumping system includes at least one pumping element comprising a piston separating a working chamber from a process chamber. A closed loop hydraulic system is in fluid communication with the working chamber. The closed loop hydraulic system contains a working fluid. Fluid communication between the closed loop hydraulic system and the working chamber includes a high pressure line and a low pressure line. A production line and a well are in fluid communication with the process chamber.

Further aspects and advantages of the invention will be apparent from the following description and the appended claims.

DETAILED DESCRIPTION

According to one aspect of the invention, a pressure driven pumping system includes one or more pumping elements each having a "dogbone" arrangement that divides the interior of a housing into four different variable volume chambers. The power fluid (or working fluid) operates on one end of the dogbone during the fill stroke and on an opposing end during the pump stroke. In some embodiments, the working fluid operates on equal surfaces during pump and fill strokes so that the required flow rate of power fluid to achieve a pump stroke and a fill stroke are desirably the same. The pressures required to operate the dogbone during the pump and fill strokes may also be equal. Power may be supplied by a single conduit to multiple pumping elements that operate independently at different dogbone positions. A damping vessel may be included that provides a barrier between working fluid and ambient seawater to prevent contamination of the seawater. Pressure may be maintained to prevent total separation of multiphase fluid components, and to prevent damaging pressure drops or water-hammering effects. Although the invention will be discussed primarily in the context of pumping production fluids from a completed well to the surface or another location, those of at least ordinary skill in the art will appreciate that the invention may also be useful in a variety of other pumping applications.

Figure 1:
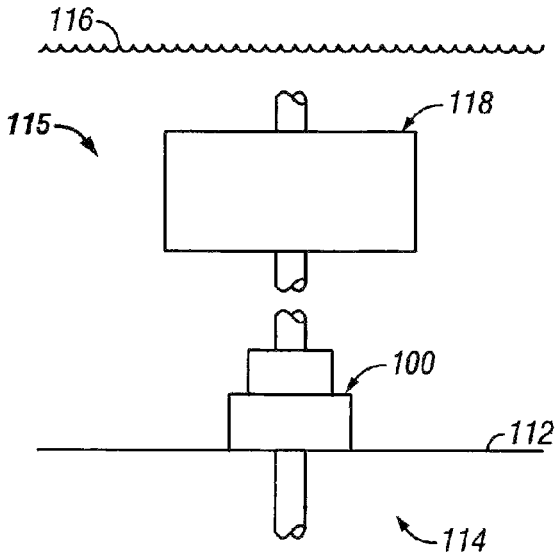
FIG. 1 conceptually depicts the environment of a subsea wellhead system for controlling fluid flow from a subsea formation in accordance with an embodiment of the present invention.

FIG. 1 conceptually depicts a subsea wellhead system 100 for controlling fluid flow from a subsea formation 114 to above a waterline 116 (the "surface") where it can be transported to another location for further processing. The subsea wellhead system 100 may include sub-systems known in the art, such as production "Christmas trees," for producing fluids from a hydrocarbon formation. At least a portion of a pumping system 118 is positioned in ambient seawater 115 for pumping flow from the wellhead system 100 to the surface 116. Pressure within a well varies over the life of the well. Initially, fluids within the formation 114 may be at very high pressures, and provide at least some of the pressure required to lift the well fluids to the surface. As time passes, pressure in the formation 114 typically decreases, even though the formation 114 is still capable of producing in profitable quantity. The pumping system 118 must therefore be capable of reliably pumping fluid over the life of the well, despite changes in well pressure over time.

Figure 2:
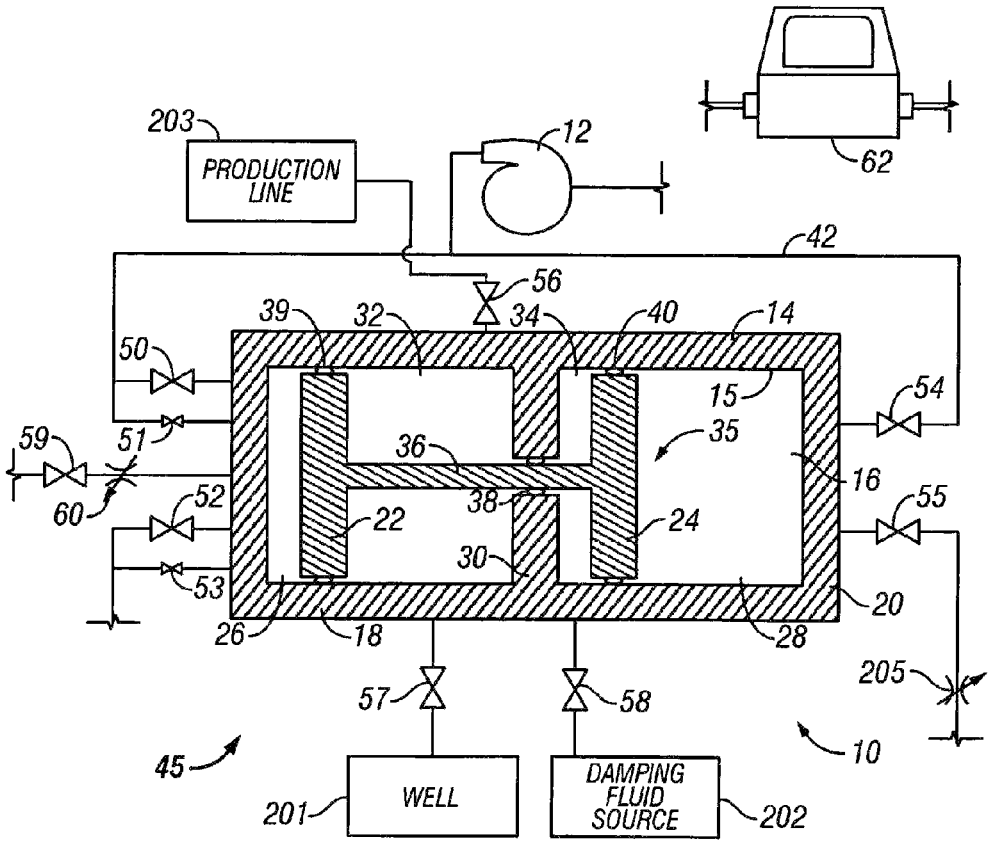
FIG. 2 shows a pumping element at the beginning of a pump stroke in accordance with an embodiment of the present invention.

FIG. 2 shows a pressure driven pumping element 10 powered by a pump 12 in accordance with an embodiment of the present invention. A housing 14 has a bore 16 defined by an inner surface 15 of the bore 16. The bore 16 is partially bounded by first and second housing walls 18, 20. A "static" separating member 30, which in FIG. 2 is an inner wall 30, is disposed within the bore 16. In FIG. 2, the inner wall is centrally located, and may thus be referred to as a central wall 30, although in other embodiments it need not be centrally located. First and second "dynamic" separating members, which in FIG. 2 are pistons 22, 24, are movably disposed within the bore 16. The first piston 22 is positioned between the first wall 18 and an inner wall 30 to define a variable volume first outer chamber 26 and a variable volume first inner chamber 32. The second piston 24 is positioned between second wall 20 and central wall 30 to define a variable volume second inner chamber 34 and a variable volume second outer chamber 28. A coupling member 36 couples the first and second pistons 22, 24 and passes through the central wall 30, such that the first and second pistons 22, 24 are movable together to vary the volumes of the outer chambers 26, 28 and the inner chambers 32, 34. The first and second pistons 22, 24 and the coupling member 30 may be collectively referred to as a "dogbone," generally indicated at 35. Sealing member 38 seals between inner chambers 32, 34, sealing member 39 seals between outer chamber 26 and inner chamber 32, and sealing member 40 seals between outer chamber 28 and inner chamber 34. The sealing members 38-40 may be selected from a variety of annular seals known in the art, and typically comprise o-rings as shown.

The dynamic separating members are so termed because they are generally movable with respect to the housing, and the static separating member is so termed because it is generally fixed with respect to the housing. It may be possible according to some embodiments to construct an operable pumping element whose static separating member is movable to some degree with respect to housing. However, it is advantageous for the static separating member to remain fixed, at least in the embodiment shown, so that movement of the dogbone 35 causes a predictable change in volumes of the four chambers 26, 28, 32, 34.

It is conventional to refer to "process fluid" as that fluid being pumped, e.g., produced hydrocarbons or drilling mud being pumped from the well to the surface. It is conventional to refer to "working fluid" or "power fluid" as that fluid being used to drive an element, such as the dogbone 35. Seawater is often used as the working fluid, both because there is a virtually infinite supply of it, and because seawater hydrostatic pressure can often be used to assist the driving of the pumping element. The sea also provides an essentially limitless reservoir for discharged seawater. In the description that follows, therefore, the working fluid is assumed to be seawater, and the process fluid is assumed to be well fluid.

Generally, either both of the outer chambers or both of the inner chambers are working chambers for receiving seawater. This is so that seawater may be applied to drive the dogbone in either direction. Seawater may be pumped to one working chamber to move the dogbone during a pump stroke, and may be pumped to the other, opposing working chamber to move the dogbone during a fill stroke. This may also allow seawater to be applied to equal surface areas during the pump and fill strokes. Thus, either both of the outer chambers are working chambers, one of the inner chambers is a process chamber, and the other of the inner chambers is a fourth chamber; or both of the inner chambers are working chambers, one of the outer chambers is a process chamber, and the other of the outer chambers is a fourth chamber. The fourth chamber may be used for damping, as discussed below.

Referring specifically to the embodiment shown in FIG. 2, the outer chambers 26, 28 are designated as working chambers, inner chamber 32 is the process chamber, and inner chamber 34 is a "fourth" chamber that can be used for damping. The well fluid in this embodiment contains hydrocarbons from the well, which may include multiphase constituents such as gas and liquid. A plurality of valves 50-58 are included for controlling fluid flow to the various chambers, as follows:

- Valve 50 controls flow between pump 12 and outer chamber 26.
- Compression Valve 51 also controls flow between pump 12 and outer chamber 26, and may be used for a compression step discussed below.
- Valve 52 controls flow between outer chamber 26 and ambient seawater 45.
- Decompression valve 53 also controls flow between outer chamber 26 and ambient seawater 45, and may be used for a decompression step discussed below.
- Valve 54 controls flow between outer chamber 28 and pump 12.
- Valve 55 controls flow between outer chamber 28 and ambient seawater 45.
- Valve 56 controls flow between working chamber 32 and a production line 203.
- Valve 57 controls flow between a well 201 and working chamber 32.
- Valve 58 controls flow between fourth/damping chamber 34 and a damping fluid source 202, such as seawater.

A number of ways to operate valves are known in the art, and an electronic control unit is typically used for coordinating the functioning of multiple valves, especially in a remote subsea location. A representative control unit 62 is depicted, which may include a number of inputs and outputs for actuating the various valves, a logic circuit or "CPU", pump-regulating software for coordinating the operation of the valves, and a display and peripherals for displaying data and interfacing with a human operator. Also, those having ordinary skill in the art will appreciate that more or less valves may be used depending on the application.

In one aspect, a pumping cycle includes a fill stroke, a compression stroke, a pump stroke, and a decompression stroke. The fill stroke fills the process chamber 32 with well fluid, moving the dogbone 35 from its position in FIG. 3 to its position in FIG. 2. The compression stroke then raises the pressure in process chamber 32 from wellhead pressure to about discharge pressure. The pump stroke pumps well fluid out of process chamber, moving the dogbone 35 from its position in FIG. 2 to its position in FIG. 3. The decompression stroke lowers pressure in the process chamber 32 to about inlet pressure.

Figure 3:
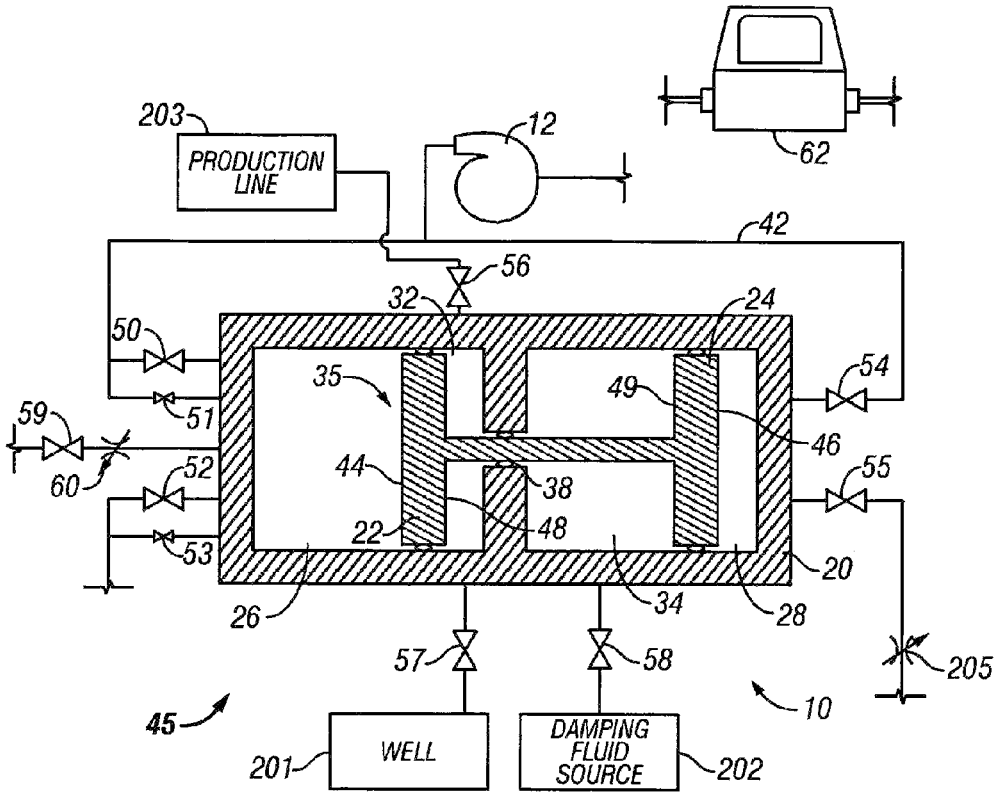
FIG. 3 shows the pumping element shown in FIG. 2 at the beginning of a fill stroke.

Fill Stroke: FIG. 3 shows the pumping element 10 at the beginning of a fill stroke. Valves 52, 54, 57, and 58 are opened, and valves 50, 55, and 56 are closed. Valves 51 and 53 are also closed. Pump 12 pumps seawater through valve 54 into working chamber 28, moving dogbone 35 toward housing wall 18. This movement of the dogbone 35 fills process chamber 32 with well fluid. Simultaneously, this movement of the dogbone 35 discharges seawater through valve 52 to ambient seawater 45 and discharges seawater from damping chamber 34 through valve 58 to ambient seawater 45. In one embodiment, seawater may instead be discharged to a depleted subsea formation used for storing contaminated seawater.

Compression Stroke: The compression stroke raises the pressure in process chamber 32 from about wellhead pressure (external to valve 57) to about discharge pressure (external to valve 56). Immediately following the fill stroke, pressure in the process chamber 32 is typically at about wellhead pressure, although it may deviate slightly from wellhead pressure, due to line losses, elevation changes, and so forth. Discharge pressure is significantly higher than wellhead pressure, however, because that is the pressure to which well fluid has been increased to pump it to a subsequent location, such as a subsea storage tank or a pipeline. Normally, fluid flows out of process chamber 32 through valve 56 during the pump stroke (see below). If valve 56 were opened without first increasing pressure in process chamber 32, however, well fluid in the production line 203 would instead flow back into process chamber 32 due to the pressure differential across valve 56.

Still referring to FIG. 3, the compression stroke begins with valves 50, 52, 54, 56, and 57 closed. Decompression valve 53 is also closed. Valves 55 and 58 are open. Compression valve 51 is opened to pump seawater from pump 12 into working chamber 26, to increase the pressure therein. Compression valve 51 may have a lower valve flow coefficient (Cv) such that compression valve 51 passes fluid at a lower flowrate than valve 50 to increase pressure in chamber 32. The lower flowrate is desirably useful to limit the speed at which dogbone 35 is driven (if at all) when opening compression valve 51 in order to reduce pressure surges in the production line 203. Compression valve 51 may provide the lower flowrate in a number of ways. For example, compression valve 51 may have a relatively small orifice, or a variable orifice that is only slightly "cracked open." Some embodiments of the compression valve 51 may, for instance, include a throttle valve, a choke valve, or a gate valve.

Pump Stroke: FIG. 2 shows the pumping element 10 near the beginning of a pump stroke. Valves 52, 54, and 57 are closed, along with compression valve 51 and decompression valve 53. Valves 50, 55, 56, and 58 are opened. Pump 12 pumps seawater through valve 50 and into working chamber 26, moving dogbone 35 toward the housing wall 20. This movement of the dogbone 35 discharges well fluid from process chamber 32 to a production line 203. Simultaneously, the movement of the dogbone 35 discharges seawater from working chamber 28, while drawing seawater into damping chamber 34.

If the discharge pressure in the production line 203 is substantially lower than ambient seawater hydrostatic pressure, it may be possible to instead use hydrostatic pressure to move the dogbone 35 during the pump stroke. For example, valve 50 would remain closed, and valve 59 may be opened to ambient seawater. Valve element 60, which may be a valve or a choke, would be used to control the rate at which ambient seawater enters working chamber 26, thereby controlling the speed of the pump stroke.

Decompression Stroke: Referring to FIG. 3, the decompression stroke lowers pressure in the process chamber 32, preferably from the discharge pressure to about wellhead pressure. The decompression stroke helps prevent a sudden and potentially harmful pressure change when valve 57 is opened on the next fill stroke. Whereas immediately following the fill stroke, well fluid in process chamber 32 was at about inlet pressure, the pressure in process chamber 32 is typically at or about discharge pressure immediately following the pump stroke. Thus, opening valve 57 without decompressing the well fluid could cause flow of the well fluid to reverse, whereby well fluid would flow back out through valve 57.

Decompression begins with all valves 51-56 and 58 initially closed. Decompression valve 53 is opened to decompress well fluid in the process chamber 32. As with compression valve 51, decompression valve 53 may include a small or variable orifice to minimize flow rate through decompression valve 53, to limit the speed and forcefulness of the pressure change. The decompression stroke may now be followed by another fill stroke, and the pumping system may continue to cycle from fill stroke, to compression stroke, to pump stroke, and to decompression stroke. Those having ordinary skill in the art will appreciate that the decompression stroke does not need to be entirely distinct from the prior pump stroke and subsequent fill stroke because pressure in the process chamber 32 equalizes to some extent as the process chamber 32 discharges the well fluid during the prior pump stroke and the subsequent fill stroke begins with the switching of flow from pump 12 to fill working chamber 28, which moves dogbone 35 towards housing wall 18. This movement of the dogbone 35 immediately reduces the pressure inside the process chamber 32 and draws fluid through the valve that is open, which is valve 57 during the fill stroke.

One advantage of the embodiment described above is that the working chambers 26, 28 can receive working fluid, such as seawater, from a single working fluid source. In particular, pump 12 may supply both working chambers 26, 28 through a single conduit 42, to provide working fluid for both the pump and fill strokes.

Another advantage is that, in one embodiment, working fluid may flow at substantially equal rates and at substantially equal pressures during the pump stroke and the fill stroke. Referring to FIG. 3, the first piston 22 has a first working surface 44 exposed to working chamber 26, and the second piston 24 has a second working surface 46 exposed to working chamber 28. The first and second working surfaces 44 and 46 have substantially equal areas. (It may be observed that, in embodiments wherein the inner chambers 32, 34 are instead configured to be the working chambers, with one of the outer chambers being a process chamber, inner surfaces 48 and 49 would be working surfaces also having substantially equal areas.) Although not required, an advantage of working surfaces having substantially equal areas is that fluid may be supplied at the same rate and at the same pressure for fill and pump strokes. A choke 205 may be placed in the same line as valve 55 to have both substantially equal flow rates and pressures during the pump stroke and the fill stroke. This is particularly advantageous given that the single conduit 42 is supplying seawater to both working chambers 26, 28. The control unit 62 may also be configured for controlling the plurality of valves to ensure that seawater is supplied to each of the working chambers at substantially the same rate.

Figure 4:
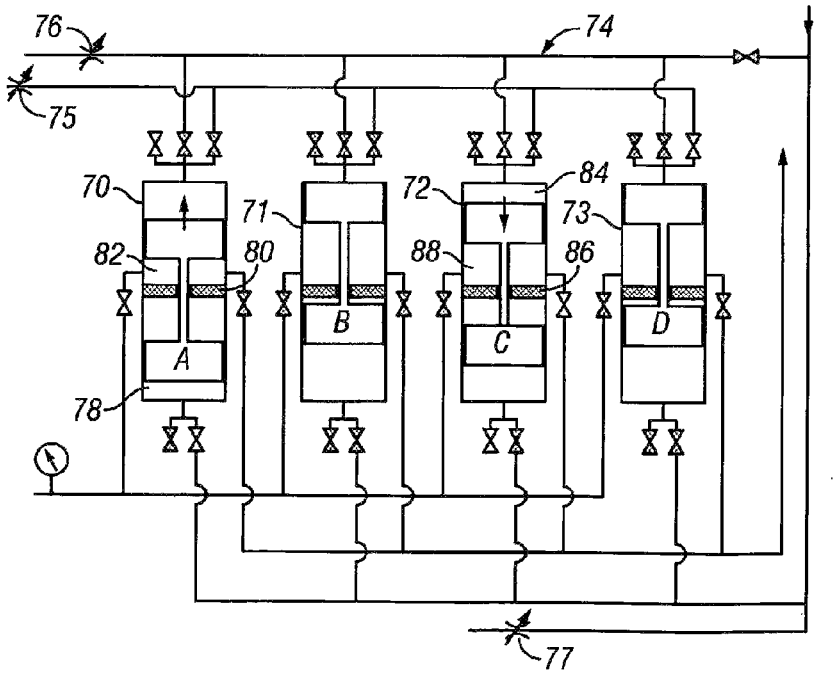
FIG. 4 shows a pumping system having multiple pumping elements in accordance with an embodiment of the present invention.

According to some embodiments, three or more pumping elements are included. If one fails, its valves may be held closed and the remaining chambers will continue to function. FIG. 4, for example, shows a "quadraplex" embodiment wherein four pumping elements 70, 71, 72, 73 are arranged in a manifold generally indicated at 74. A number of chokes 75, 76, 77 are included within the manifold 74 to control inlet and outlet pressures as necessary. The pumping elements 70-73 each have a respective dogbones labeled A, B, C, and D. Dogbones B and D are shown at the end of a fill stroke. Dogbone A is shown during a fill stroke, while dogbone C is shown during a pump stroke. Thus, in element 70, seawater is being pumped to the working chamber 78 located opposite the central wall 80 from the process chamber 82, to draw well fluid into the process chamber 82 during the fill stroke. Simultaneously, in element 72, seawater is pumped to the working chamber 84 located on the same side of the central wall 86 as the process chamber 88, to discharge well fluid out of the process chamber 88 during the pump stroke.

In the embodiments of FIGS. 2 and 3, the fourth chamber 34 may be used as a damping chamber. Valve 58 may remain open during the pump and fill strokes, so that as dogbone 35 moves, fluid is passed in and out of damping chamber 34. Passing fluid through the valve 58 dampens movement of dogbone 35, and that damping may be controlled by the amount of flow restriction provided by valve 58. Valve 58 may have a variable restriction, to adjust the amount of damping. Damping chamber 34 may communicate directly with ambient seawater 45, as shown, so that the seawater 45 serves as the damping fluid.

Figure 5:
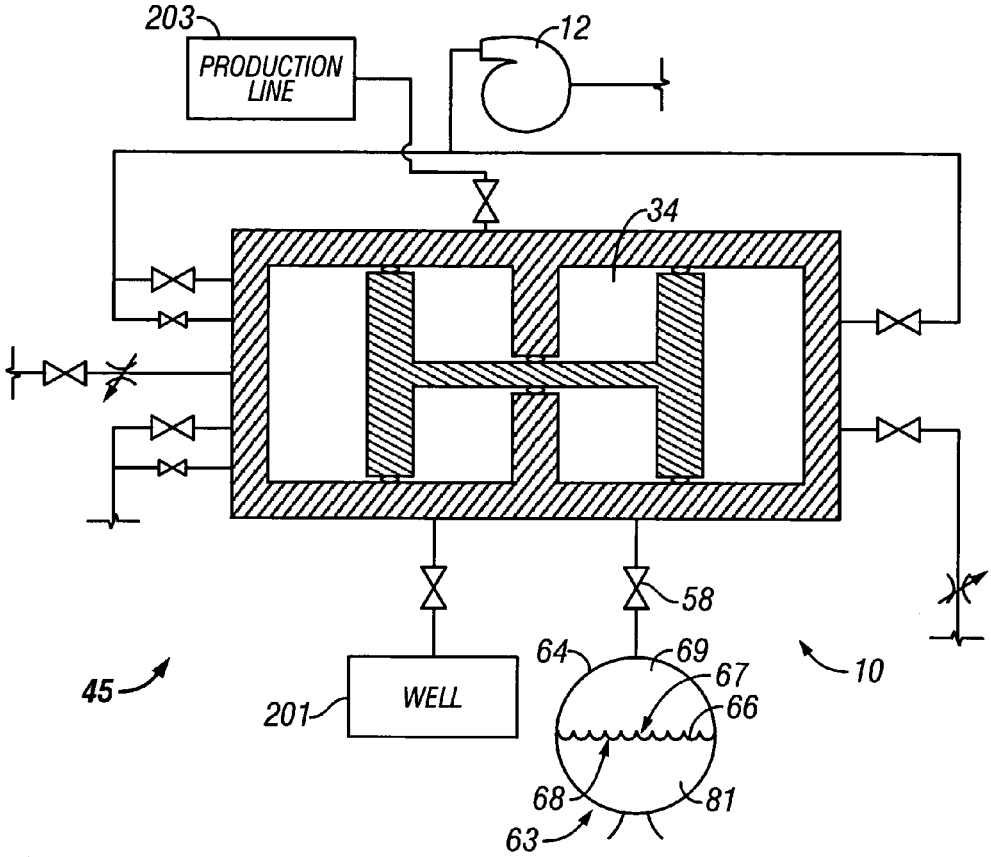
FIG. 5 shows a pumping element connected with a pulsation dampener in accordance with an embodiment of the present invention.

Over time, well fluid may leak past seal 38 into damping chamber 34, and if the damping chamber 34 is in direct communication with ambient seawater 45 as shown in FIG. 3, well fluid may exit with seawater during fill strokes to undesirably contaminate the ocean. To avoid this situation, FIG. 5 shows the pumping element 10, wherein the damping chamber 34 is instead placed in communication with a damping vessel conceptually depicted at 63 for passing damping fluid between the damping chamber 34 and the damping vessel 63. A damping housing 64 is in communication with the damping chamber 34. A movable fluid barrier 66 is disposed within the damping housing 64, defining a closed variable volume bounded by the damping chamber 34, the housing 64, and the fluid barrier 66. A benign damping fluid may be used to fill this closed volume. The fluid barrier 66 divides the housing 34 into a first portion 69 and a second portion 81. An inner surface 67 of the fluid barrier 66 is exposed in the first portion 69 to the damping fluid. An outer surface 68 of the fluid barrier 66 is exposed in the second portion 81 to an external fluid, which in this case is ambient seawater 45.

The fluid barrier 66 thereby separates the damping fluid from the seawater, preventing damping fluid (and any traces of well fluid leaked into the damping fluid) from passing to the ocean. The fluid barrier 66 is moveable in response to a pressure differential between the damping fluid in first portion 69 and seawater in the second portion 81. During the fill stroke (FIG. 2), damping chamber 34 decreases in volume, discharging damping fluid into first portion 69 of the damping vessel 63. This moves the fluid barrier 66, working against seawater 45 located in the second portion 81, to discharge the seawater 45 from damping vessel 63. During the pump stroke (FIG. 3), damping chamber 34 increases in volume, drawing damping fluid into the damping chamber 34 from first portion 69 of the damping vessel 63. This moves the fluid barrier 66 to draw seawater 45 into the second portion 81.

In some embodiments, the fluid barrier 66 may be a diaphragm or bladder, as shown. In other embodiments the vessel 64 may instead be a cylinder and the fluid barrier 66 may be a piston. More than one pumping element 10 may be connected to the damping vessel 63. Likewise, more than one damping vessel 63 may be arranged in parallel, in communication with one or more pumping elements 10. The damping vessel 63 may alternatively be referred to as a "pulsation dampener," because its damping effect can minimize the possibility of harmful pulses that may occur.

Figure 6:
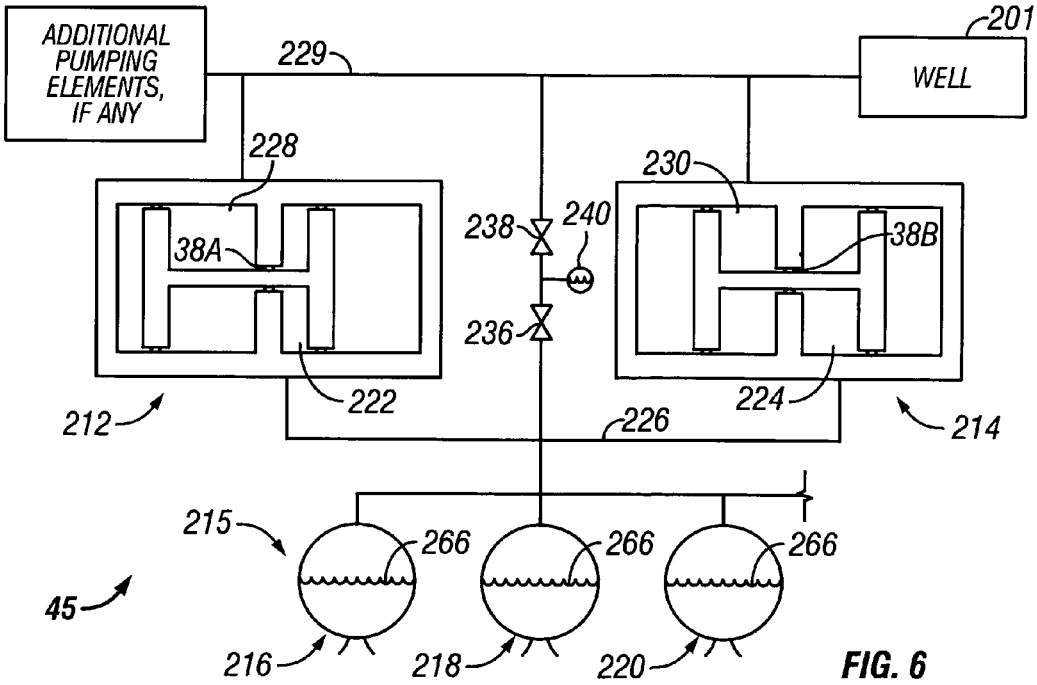
FIG. 6 shows a multiple pumping elements linked together with multiple pulsation dampeners in accordance with an embodiment of the present invention.

FIG. 6 shows a portion of an alternative pumping system configuration in accordance with one embodiment of the present invention. Note that for the purpose of clarity, many features of the pumping elements described above are not shown in FIG. 6. The pumping system shown in FIG. 6 includes two dogbone pumping elements 212 and 214, and set 215 of three pulsation dampeners 216, 218, 220. Damping chambers 222 and 224 are connected in parallel to the pulsation dampeners 216, 218, 220, which are also in parallel, via manifold 226. Well fluid passes from the well 201 to process chambers 228, 230 along line 229. The pulsation dampeners 215 are shared between at least the two pumping elements 212, 214 shown. Leakage past seals 38A, 38B can eventually cause excess fluid to accumulate in the set of pulsation dampeners 215. This leakage may be detected using a position indicator known in the art, placed in communication with the fluid barriers 266.

To alleviate this excess accumulation of fluid in the set of pulsation dampeners 215, one or more valves 236, 238 may be used to vent excess fluid back to pump suction. Using two valves allows creation of a "pressure lock" so that the pulsation dampeners 215, normally at ambient hydrostatic pressure, do not completely vent to the pump inlet. A small pulsation dampener 240 may be included to accept the volume in the pressure lock.

Figure 7:
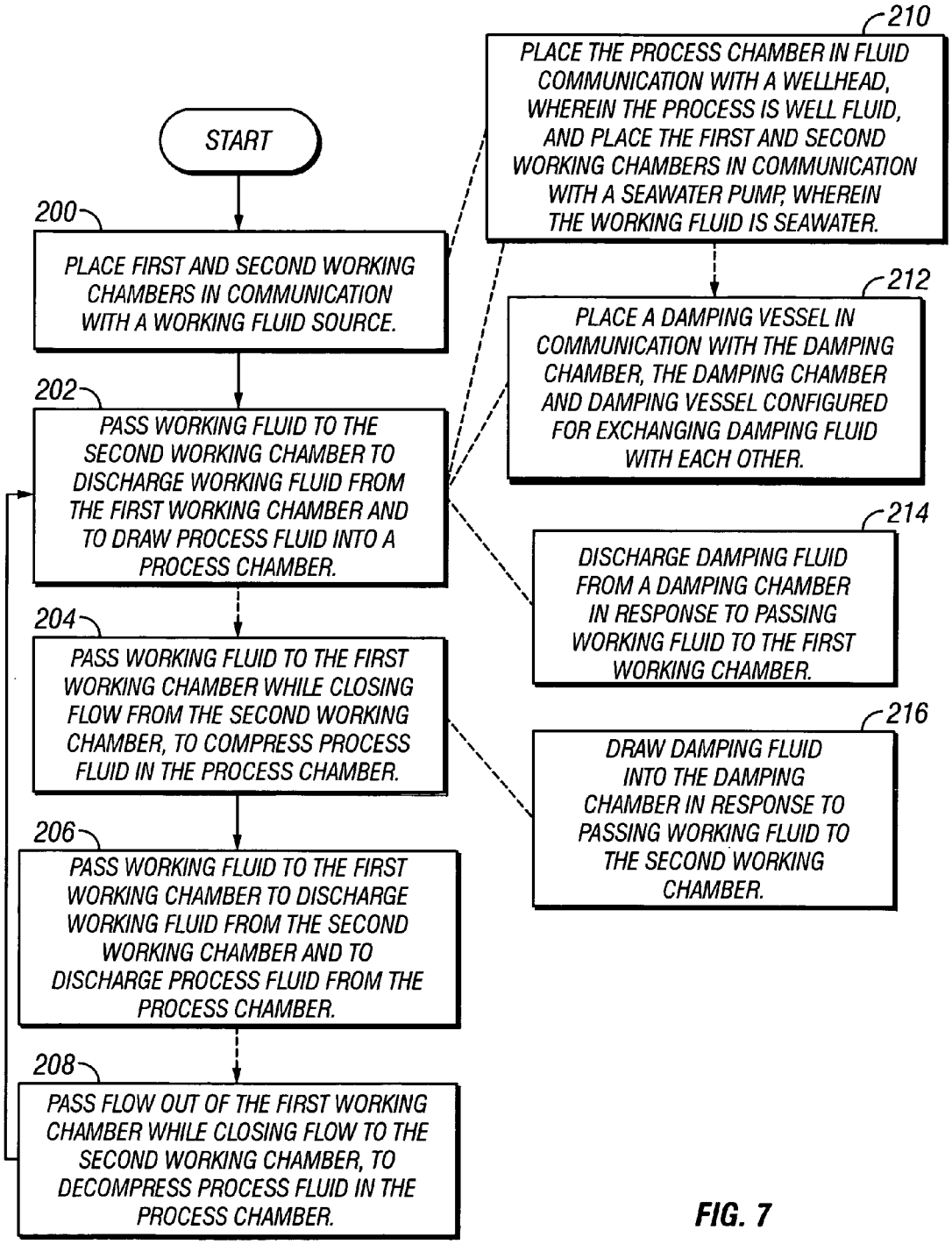
FIG. 7 shows a flowchart describing a method of pumping in accordance with an embodiment of the present invention.

FIG. 7 is a flowchart describing a method of pumping according to an aspect of the invention, wherein dashed lines indicate optional steps or conditions. In step 200, first and second working chambers are placed in communication with a working fluid source. Step 202 is a fill step, wherein process fluid is drawn into a process chamber. Step 204 is a compression step, wherein the process fluid in the process chamber is compressed. Step 206 is a pump step, wherein process fluid is discharged from the process chamber. Step 208 is a decompression step, wherein process fluid in the process chamber is decompressed. Process fluid may be pumped by cycling repeatedly through steps 202, 204, 206, and 208. Step 210 places the process chamber in communication with a wellhead, and places the first and second working chambers in communication with seawater. Step 212 places a damping vessel in communication with the damping chamber. In step 214, damping fluid is discharged from the damping chamber in response to step 202. In step 216, damping fluid is drawn into the damping chamber in response to step 216.

Figure 8:
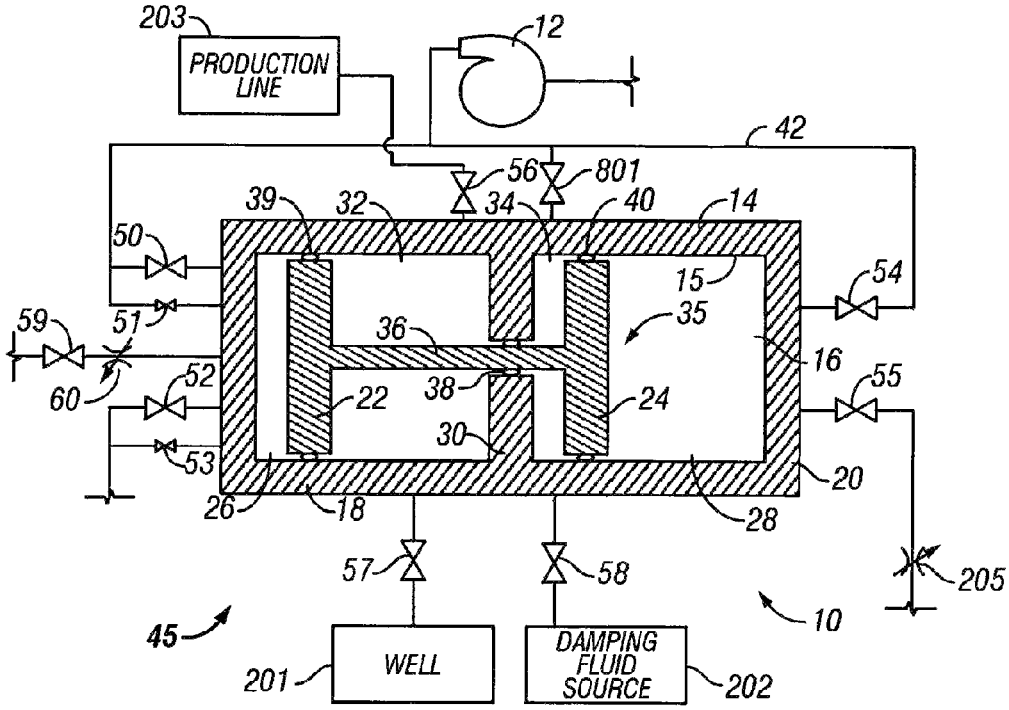
FIG. 8 shows an embodiment of a pumping element at the beginning of a pump stroke in accordance with an embodiment of the present invention.

Turning to FIG. 8, a pumping element in accordance with an embodiment of the present invention is shown. The pumping element 10 is similar to the embodiment shown in FIG. 2. As with FIG. 2, the pumping element 10 in FIG. 8 is at the start of the pump stroke. The pumping element in FIG. 8 includes an additional valve 801 that is in parallel with valve 50. In some applications, it may be desirable to have a stronger pump stroke than can be accomplished by pump 10 acting against piston 22. To boost the pump stroke, both valve 50 and valve 801 may be opened, which allows pressure in the working fluid to act against the backside (i.e. the side that is exposed to the damping chamber) of piston 24. This nearly doubles the effective area that the working fluid acts against, which can allow for nearly double the pump stroke force depending on the capabilities of the pump 12.

The inventor notes that the "boosted" pump stroke will result in a decrease in the pump efficiency of the pumping element 10. Using the boosted pump stroke over an extended period of time may also damage components in the pumping element 10 and those connected to it (particularly to components connected to the production line 203) as a result of the increased pressure spike. One potential application for a boosted pump stroke is for the purpose of clearing out build up in the production line 203. In one embodiment, the pumping element 10 may be run in the boosted mode until flow through the production line 203 improves by a selected amount. Pressure loss in the production line 203 may be used to determine the quality of flow. In one embodiment, boosted mode may be selected remotely, which causes valve 801 to act in conjunction with valve 50. The default mode of the embodiment could be for valve 801 to remain closed.

Figure 9:
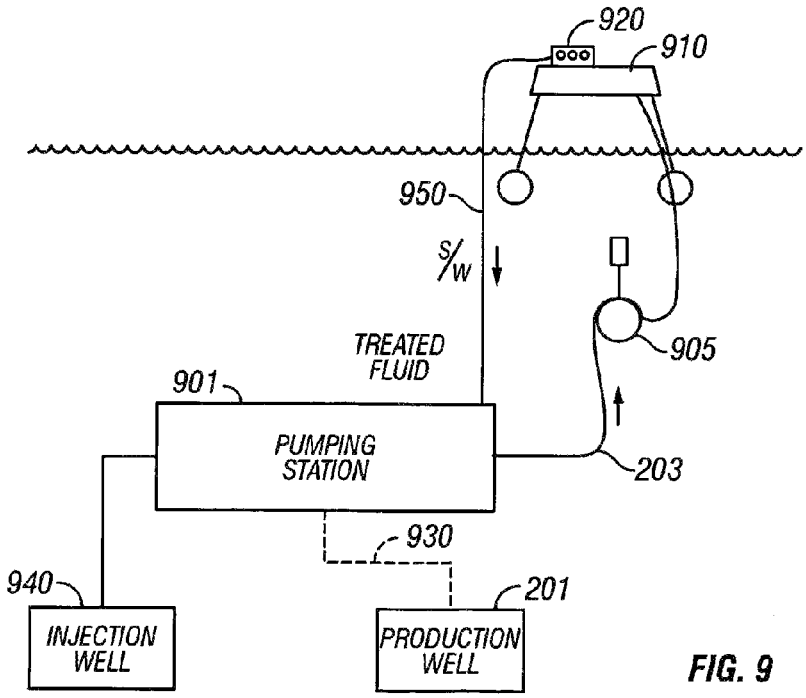
FIG. 9 shows a pumping system using the pressure of an injection well to assist in pumping in accordance with an embodiment of the present invention.

In FIG. 9, a configuration for a pumping system 901 in accordance with an embodiment of the present invention is shown. The pumping system 901 in FIG. 9 may be configured so that well fluid from a well 201 (referred to as "production well 201" for clarity in FIG. 9) is assisted while pumping injection fluid into an injection well 940 from an injection fluid apparatus 920 located at the offshore well site 910. As used herein, "injection fluid apparatus" refers to the apparatus or combination of apparatuses that provides injection fluid. In FIG. 9, the pumping system 901 is illustrated as a block and may be any pumping system that is configured such that an external pressure source can assist the actuation of the pumping system, such as embodiments of the invention described above. Injection wells such as 940 are commonly used in the oilfield for disposal of contaminated fluids and for maintaining pressure in a reservoir from which one or more production wells such as 201 are producing.

In a typical injection well offshore for pressurizing the reservoir, saltwater is filtered and treated in an injection fluid apparatus 920 and then pumped into the injection well 940. In the embodiment shown in FIG. 9, the injection fluid is pumped through injection line 950 to pumping system 901 as described above with respect to the pumping element shown in FIG. 2. The injection fluid acts as the working fluid. In the fill stroke, as the injection fluid is pumped into the injection well 940 (instead of being discharged to ambient seawater as in FIG. 2), well fluid is drawn from the production well 201. Then, during the pump stroke, injection fluid is pumped into the pumping system 901 from the injection fluid apparatus, which pumps well fluid through production line 203 to a subsequent location, such as a riser 905.

An advantage of combining injecting fluid into an injection well 940 while drawing well fluid from production well 201 is that a single surface pump can be used to both supply the injection well 940 and actuate the pumping system 901. Further, the relative pressures between the injection well, the production well 201, and the hydrostatic pressure at the depth of the pumping system 901 can be used to reduce the amount of pressure needed from a surface pump to actuate the pumping system 901. Typically, a production well 201 has a lower pressure than an injection well, in particular one that is being used to recharge the same formation as the production well is drawing well fluid from. Depending on the particular injection well 940 and the depth at which the pumping system 901 is located, the pressure of the injection well 940 may be lower than the hydrostatic pressure of the ambient seawater. When the injection well 940 has a lower pressure than the ambient seawater, the pressure required from a surface pump to draw well fluid from the production well 201 during the fill stroke is reduced by about that pressure differential.

In effect, a negative pressure differential between the injection well 940 and the ambient seawater acts as a "free pump" to reduce pressure resistance to the surface pump as it actuates the pumping system 901 to draw well fluid from the production well 201. For example, an injection well 940 typically has a pressure of about 1500 psi to about 1800 psi. Assuming that the injection well 940 has a pressure less than about 1800 psi and that the pumping system 901 is submerged in seawater, a negative pressure differential between the ambient seawater and the injection well 940 would exist when the pumping system 901 is submerged at a depth greater than about 4050 feet. For a pressure less than about 1500 psi, the negative pressure differential would exist when the pumping system 901 is submerged at a depth greater than about 3380 feet. Those having ordinary skill in the art will appreciate that a negative pressure differential is only needed to provide pressure assistance from the injection well 940, and that other advantages may exist when the injection well 940 and the production well 201 are connected to a common pumping system 901 even when the pressure of the injection well 940 is greater than the hydrostatic pressure at the depth at which the pumping system 901 is submerged. Further, although the greatest hydrostatic pressure exists on the sea floor, embodiments of the present invention, including the one shown in FIG. 9, do not require that the pumping system 901 to be on the sea floor or in any other specific location or depth.

Figure 10:
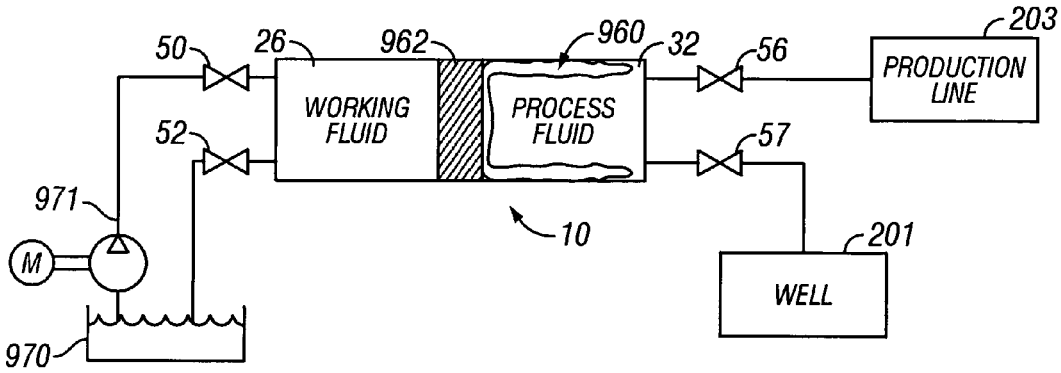
FIG. 10 shows a pumping system having a hydraulic system for actuating the pumping system in accordance with an embodiment of the present invention.

Although the embodiments discussed above are generally described in subsea (i.e. submerged) applications, those having ordinary skill in the art will appreciate that pumping systems described herein may provide one or more of the disclosed advantages when used in surface applications. FIG. 10 shows a pumping system in accordance with one embodiment of the present invention. The pumping system includes a pumping element 10 having a piston 962 disposed therein separating a working chamber 26 from a process chamber 32. In this embodiment, the pumping element 10 has a working chamber 26 that is in fluid communication with a hydraulic system 970, which may be a closed-loop system using a hydraulic fluid such as oil. The pumping element 10 shown in FIG. 10 differs from other pumping elements described above in that it includes a single working chamber 26. Because there is only one working chamber 26, the piston 962 can only be pressurized by working fluid from one side, unlike the dog-bone arrangement for which working fluid can act in two directions for drawing process fluid during a fill stroke and pumping fluid during the pump stroke. The pumping element 10 shown in FIG. 10 is more suitable for a well that has sufficient pressure to produce to the surface without being drawn, or when used in combination with another pumping system disposed between the well 201 and pumping element 10.

In operation, the pumping system shown in FIG. 10 may function as follows. With valves 972 and 57 open and valves 971 and 56 closed, the pressure in the working chamber 26 may be about equal to the atmospheric pressure at the surface. If the well 201 has sufficient pressure, or is assisted by an additional pumping system disposed between the well 201 and pumping element 10, the well fluid will fill process chamber 32 causing piston 962 to slide to reduce the volume in the working chamber 26 as the volume in the process chamber 32 is increased. Valves 52 and 57 may then be closed and valves 50 and 56 opened for the pump stroke. The opening of valve 50 allows pressurized working fluid to enter the working fluid chamber 26 and push against piston 962 to discharge the well fluid through the production line 203. In one embodiment, the pumping system may be configured to have a compression stroke and a decompression stroke by adding a compression valve 51 and a decompression valve 53, as disclosed above with respect to FIGS. 2 and 3. In one embodiment, a rolling diaphragm 960 may be installed in the process chamber 32 to aid in preventing leakage of working fluid or well fluid across piston 962.

Although FIG. 10 shows a pumping system having a single pumping element 10, those having ordinary skill in the art will appreciate that multiple pumping elements 10 may be combined to provide a more constant fluid flow. In one embodiment, two or more pumping elements 10 may be connected in parallel to the high pressure output 971 of the hydraulic system 970. Each pumping element 10 could include a valve 50 that controls fluid between its working chamber 26 and the shared high pressure output 971. A similar parallel arrangement may be used to place the process chamber 32 of each pumping element 10 and the well 201.

The pumping element 10 shown in FIG. 10 provides a useful pumping action for producing from a well 201 that has sufficient pressure to bring well fluid to the surface. In producing gaseous hydrocarbons, the pumping element 10 provides a useful function by controlling the volumetric change of the gaseous hydrocarbons. The controlled pumping of liquid hydrocarbons that can be performed by pumping element 10 may be useful as well. One limitation of the pumping element 10 as shown in FIG. 10 is that assistance is required if the well 201 has insufficient pressure to perform the fill stroke. In that situation, an additional pumping system would be required between the pumping element 10 and the well 201. Alternatively, an alternate design for a pumping element 10, such as that shown in FIG. 2, may be used. In that embodiment, pump 12, which applies pressure to both working chambers 26 and 16, may be replaced with the hydraulic system 970 in a similar arrangement. Instead of discharging work fluid from the working chambers 26 and 16 to ambient, they may be vented to the hydraulic system 970, which may be configured to be a closed loop.

The pressure driven characteristic of pumping systems in accordance with one or more embodiments of the invention provides flexible options for managing production from a well. Unlike mechanically or electrically driven pumps, a pumping system having one or more pumping elements driven by pressure, such as that shown in FIG. 2, has a minimal amount of moving parts. This allows for the pumping system to be deployed over an extended period of the production life of the well as there is a reduced need for maintenance. In a subsea deployment of the pumping system, any mechanically or electrically driven pumps used for providing the pressures to drive the pumping system may be deployed at the surface so that maintenance may be more readily performed on the mechanically or electrically driven pump. Further, should an individual pumping element fail, the remaining pumping elements may continue to operate at about the same flow rate because the pressure timed events actuating the dogbone will automatically occur at a proportionally higher rate. In one embodiment, a communication device may be connected to a sensor that is included in one or more pumping elements to indicate how well the pumping system is operating.

For example, the sensor may signal the stroke of a dogbone or piston. The strokes may be counted over a period of time to indicate the rate at which the pumping element is actuating. If the pumping system includes four pumping elements and one fails. The sensor could indicate the subsequent increase in the stroke rate, or if a single sensor is used and it is coincidentally on the failed pumping element, the zero stroke rate would also be indicated. Those having ordinary skill in the art will appreciate that many sensor and communication combinations for detecting and transmitting various parameters may be used to monitor the performance of a pumping system. By continuing to operate and signaling the malfunction, an operator may plan a repair or replacement with a reduced urgency as production from the well can continue, which prevents loss of income caused by downtime of the well. Further, production from a well is stopped, as may happen with some prior art pumping systems, the restarting of production from the well may be difficult depending on the characteristics of the well.

In one or more embodiments of the present invention, controls for operating the pumping system may be remotely accessible using existing telecommunications technology. In a subsea deployment of the pumping system, control of the pumping system may be performed by adjusting the output flow rate of the pump that provides fluid to the working chambers. This automatically reduces the stroke rate of the pumping elements, and as a result, the flow rate through the production line is decreased. Data available to an operator may include pressure at the wellhead and flow rate through the production line. In one scenario, a reservoir engineer may determine that pressure at the wellhead is decreasing too rapidly, indicating that well fluid is being produced at too high of a rate. The flow rate of the pump at the surface may be decreased to reduce the production rate and allow pressure at the wellhead to recover. In one embodiment, a rate at which the wellhead pressure may decrease may be calculated based on the properties of the well to avoid damaging the reservoir and/or provide a desired rate of production. Sensors for the wellhead pressure may be in communication with a control unit such that the control unit automatically adjusts the flow rate of the pump at the surface to increase or decrease the production rate to maintain the desired rate for drawing down the well. In another embodiment, an operator, on location or remote, may replace the control unit, monitor the wellhead pressure, and adjust the flow rate of the pump accordingly. In another embodiment, the pumping system may be used in a surface application to move fluids such as heavy crude. The draw down of the well containing the heavy crude may be dictated remotely based on a monitoring of the wellhead pressure.

The invention provides a wide range of advantages, as discussed in connection with the embodiments above. For example:

- Hydrocarbons and other fluids may be more efficiently and reliably pumped.
- Multiphase constituents may be pumped without harming the pumping elements.
- The compression and decompression strokes ensure a smooth transition between wellhead inlet pressure and wellhead outlet pressure to maintain positive fluid flow throughout the pumping cycle.
- Equal surfaces areas on opposing ends of the dogbone allow working fluid to flow at substantially the same flow rate and pressure during the fill and pump strokes.
- Working fluid may be supplied by a single conduit for both the fill and pump strokes.
- Well fluids may be contained by the damping vessel, allowing seawater hydrostatic pressure to provide damping without negative environmental consequences.

Those of ordinary skill in the art will recognize these and other advantages.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A pressure driven pumping element, comprising:

a housing having a bore at least partially bounded by first and second housing walls;

a static separating member positioned within the bore;

a first dynamic separating member movably disposed within the bore between the first housing wall and the static separating member to define a first outer chamber between the first housing wall and the first dynamic separating member and a first inner chamber between the first dynamic separating member and the static separating member;

a second dynamic separating member movably disposed within the bore between the second housing wall and the static separating member to define a second outer chamber between the second housing wall and the second dynamic separating member and a second inner chamber between the second dynamic separating member and the static separating member; and a coupling member coupling the first and second dynamic separating members and sealingly passing through the static separating member, such that the first and second dynamic separating members are movable together to vary the volumes of the outer chambers and the inner chambers;

a first inlet valve for controlling flow into the first outer chamber; and a second inlet valve for controlling flow into the first outer chamber, the second inlet valve being configured to pass flow at a slower rate than the first inlet valve, wherein one of the first inner chamber and the first outer chamber is configured to receive process fluid and the other of the first inner chamber and the first outer chamber is configured to receive working fluid, and wherein one of the second inner chamber and the second outer chamber is configured to receive damping fluid and the other of the second inner chamber and the second outer chamber is configured to receive working fluid.

2. The pressure driven pumping element of claim 1, wherein the first and second dynamic separating members each comprise a piston, and the static separating member comprises a wall fixed within the housing.

3. The pressure driven pumping element of claim 1, wherein the first and second outer chambers are configured to receive working fluid and the first inner chamber is configured to receive process fluid.

4. The pressure driven pumping element of claim 1, wherein the first and second inner chambers are configured to receive working fluid and the first outer chamber is configured to receive process fluid.

5. The pressure driven pumping element of claim 1, wherein the first and second outer chambers are configured to receive working fluid from a shared working fluid supply at substantially the same rate.

6. The pressure driven pumping element of claim 1, wherein the first dynamic separating member includes a first working surface exposed to the first outer chamber and the second dynamic separating member includes a second working surface exposed to the second outer chamber, and wherein the first and second working surfaces have substantially equal areas.

7. The pressure driven pumping element of claim 1, further comprising:

a first outlet valve for controlling flow out of the first outer chamber; and a second outlet valve for controlling flow out of the first outer chamber, the second outlet valve configured to selectively pass flow at a slower rate than the first outlet valve.

8. The pressure driven pumping element of claim 1, wherein the second inner chamber comprises a damping chamber.

9. The pressure driven pumping element of claim 8, further comprising:

a damping vessel in communication with the damping chamber for passing damping fluid therebetween.

10. The pressure driven pumping element of claim 9, wherein the damping vessel comprises a fluid barrier adapted to be exposed on an inner side to the damping fluid and adapted to be exposed on an outer side to an external fluid, the fluid barrier separating the damping fluid from the external fluid and moveable in response to a pressure differential therebetween.

11. The pressure driven pumping element of claim 10, wherein the external fluid is seawater.

12. A pressure driven pumping system comprising:

at least one pumping element, the at least one pumping element including a housing having a bore at least partially bounded by first and second outer walls;

an inner wall fixed within the bore;

a first piston movably disposed within the bore between the first outer wall and the inner wall, to define a first outer chamber between the first outer wall and the first piston and a first inner chamber between the inner wall and the first piston;

a second piston movably disposed within the bore between the second outer wall and the inner wall to define a second outer chamber between the second outer wall and the second piston and a second inner chamber between the second piston and the inner wall;

a coupling member coupling the first and second pistons and sealingly passing through the inner wall, such that the first and second pistons are movable together to vary the volumes of the outer chambers and the inner chambers;

a plurality of valves for controlling flow to at least the first and second outer chambers and the first inner chamber of the at least one pumping element; and a control unit configured for communication with the plurality of valves for controlling the plurality of valves;

wherein one of the first inner chamber and the first outer chamber is configured to receive process fluid and the other of the first inner chamber and the first outer chamber is configured to receive working fluid, wherein one of the second inner chamber and the second outer chamber is configured to receive damping fluid and the other of the second inner chamber and the second outer chamber is configured to receive the working fluid, and wherein the control unit is configured to pass flow out of the first outer chamber while closing flow to the second outer chamber, to decompress the process fluid in the first inner chamber.

13. The pressure driven pumping system of claim 12, wherein the first and second outer chambers are configured to receive the working fluid and the first inner chamber is configured to receive the process fluid.

14. The pressure driven pumping system of claim 12, wherein for the at least one pumping element, the control unit is configured to alternately pass the working fluid to the first outer chamber and to the second outer chamber.

15. The pressure driven pumping system of claim 12, wherein the control unit is configured to selectively pass flow to the first outer chamber while closing flow from the second outer chamber, to compress the process fluid in the first inner chamber.

16. The pressure driven pumping system of claim 12, wherein the control unit is configured to pass the working fluid to the first outer chamber the at least one pumping element while passing working fluid to a second chamber of another pumping element.

17. The pressure driven pumping system of claim 12, wherein the second inner chamber is configured to be open to the damping fluid for passing damping fluid in and out of the second inner chamber in response to movement of the pistons.

18. The pressure driven pumping system of claim 17, further comprising a damping vessel in communication with the second inner chamber for passing the damping fluid therebetween.

19. The pressure driven pumping system of claim 18, wherein the damping vessel comprises a fluid barrier disposed within a damping housing, the fluid barrier exposed on an inner side to the damping fluid and exposed on an outer side to seawater, the fluid barrier separating the damping fluid from the seawater and moveable in response to a pressure differential therebetween.

20. A method of pumping, comprising:

placing first and second working chambers of a pressure driven pump in communication with a working fluid source;

passing the working fluid to the second working chamber to discharge the working fluid from the first working chamber, to draw process fluid into a process chamber, and to discharge damping fluid from a damping chamber;

passing the working fluid to the first working chamber to discharge the working fluid from the second working chamber, to discharge the process fluid from the process chamber, and to draw the damping fluid into the damping chamber; and passing flow out of the first working chamber while closing flow to the second working chamber, to decompress process the fluid in the process chamber.

21. The method of claim 20, further comprising:

passing the working fluid to the first working chamber while closing flow from the second working chamber, to compress the process fluid in the process chamber.

22. The method of claim 20, further comprising:

placing a damping vessel in communication with the damping chamber, the damping chamber and the damping vessel configured for exchanging the damping fluid with each other.

23. The method of claim 20, further comprising:

placing the process chamber in fluid communication with a wellhead, wherein the process fluid is well fluid; and placing the first and second working chambers in communication with separate seawater pump, wherein the working fluid is seawater.

* * * * *